United States Patent [19]

Stull

[11] 4,119,138

[45] Oct. 10, 1978

[54] STRAIGHTENER FOR A MULTISTRAND CONTINUOUS-CASTING MACHINE

[75] Inventor: James T. Stull, Evans City, Pa.

[73] Assignee: United States Steel Corporation, Pittsburgh, Pa.

[21] Appl. No.: 846,236

[22] Filed: Oct. 27, 1977

Related U.S. Application Data

[63] Continuation-in-part of Ser. No. 710,953, Aug. 2, 1976, abandoned.

[51] Int. Cl.[2] ..... B22D 11/12; B21B 39/00

[52] U.S. Cl. ..... 164/448; 164/442; 72/226

[58] Field of Search ..... 164/442, 441, 447, 448, 164/418, 428; 72/226

[56] References Cited

U.S. PATENT DOCUMENTS 3,456,473 7/1969 Kater et al. ..... 72/226 X 3,621,694 11/1971 Greenberger ..... 72/226

FOREIGN PATENT DOCUMENTS 868,197 4/1971 Canada ..... 164/448

*Primary Examiner*—Francis S. Husar
*Assistant Examiner*—John S. Brown
*Attorney, Agent, or Firm*—Walter P. Wood

[57] ABSTRACT

A straightener for a multistrand continuous-casting machine. The straightener includes fulcrum rolls and reaction rolls which precede and follow the fulcrum rolls. The fulcrum rolls for all the strands are idlers and are coaxial, but the reaction rolls which follow the fulcrum rolls and engage intermediate strands are offset in a direction parallel to the length of the strands from the reaction rolls which engage the outer strands. The offset enable the drives for the bottom rolls opposite the intermediate reaction rolls to be connected directly to the bottom rolls.

8 Claims, 4 Drawing Figures

STRAIGHTENER FOR A MULTISTRAND CONTINUOUS-CASTING MACHINE

This application is a continuation-in-part of my earlier copending application Ser. No. 710,953 filed Aug. 2, 1976 and now abandoned.

This invention relates to an improved straightener for a multistrand continuous-casting machine.

In a connventional continuous-casting machine, after a partially solidified strand leaves the mold, it travels through a curved roll-rack which changes its direction of travel from substantially vertical to horizontal. As the strand leaves the curved roll-rack, it has a curvature similar to the path defined by the rack. Next the strand travels through a straightener which removes the curvature. A conventional straightener includes a fulcrum roll and reaction rolls preceding and following the fulcrum roll, and usually additional rolls which serve to guide and confine the strand. The fulcrum roll defines the lower tangent line beyond which the strand is straight. The fulcrum roll and the two reaction rolls absorb the forces necessary to straighten the strand. In most installations, certain rolls of the straightener are driven to assist in propelling the strand through the machine.

In a multistrand machine, where more than two strands are cast simultaneously and travel in parallel paths located close to one another, there is a problem in arranging the drives for the driven rolls. The outer driven rolls, which engage the outer strands, obstruct access to the intermediate driven rolls which engage intermediate strands. The molds in which the strands are cast are arranged with their center lines in the same plane to receive metal from the same tundish. Since the strands travel in paths having the same radii of curvature, all strands have the same lower tangent lines at the straightener and the fulcrum rolls for all the strands must be coaxial. The drives for all the driven rolls are located outside the outermost strands. When the fulcrum rolls are driven, as is a common practice, it has been necessary to employ complex gearing to transmit driving torques to the intermediate driven rolls. In actual practice such arrangements have not proved satisfactory.

An object of the present invention is to provide an improved straightener for a multistrand continuous-casting machine in which the intermediate driven rolls and their drives are offset in a direction parallel with the length of the strands from the outer driven rolls and their drives, thereby overcoming the problem encountered heretofore in transmitting driving torques to intermediate rolls.

A more specific object is to provide a straightener which accomplishes the foregoing object, but in which the drives are applied to bottom rolls opposite reaction rolls following the fulcrum rolls, and the fulcrum rolls themselves are idlers.

Figure 1:
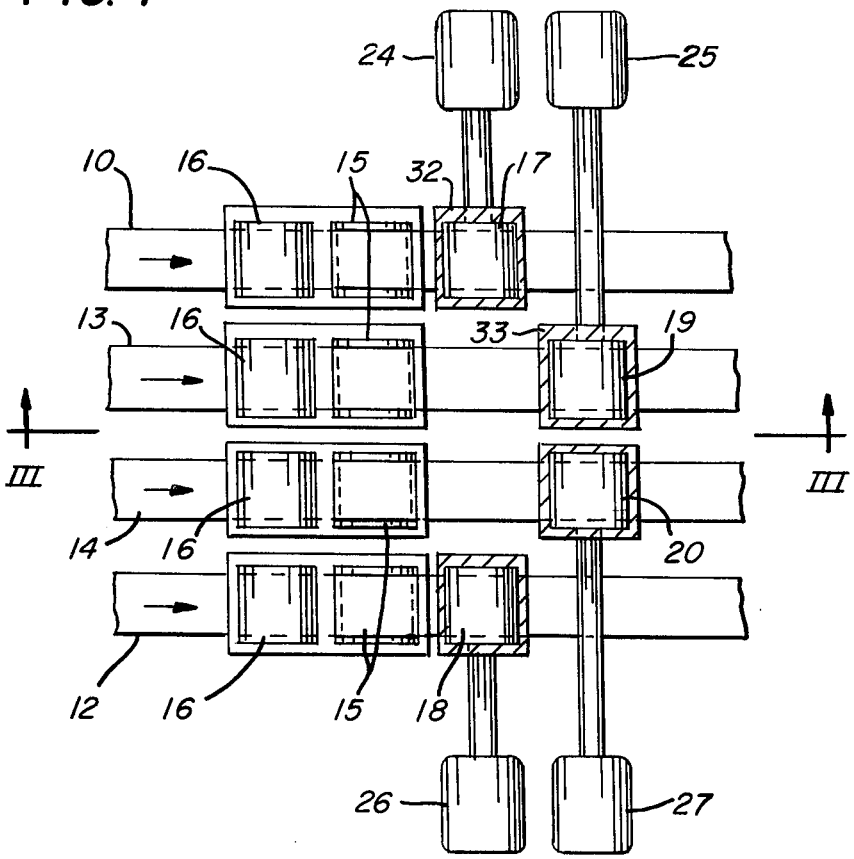
FIG. 1 is a diagrammatic layout of a straightener and drives constructed in accordance with my invention.
Figure 3:
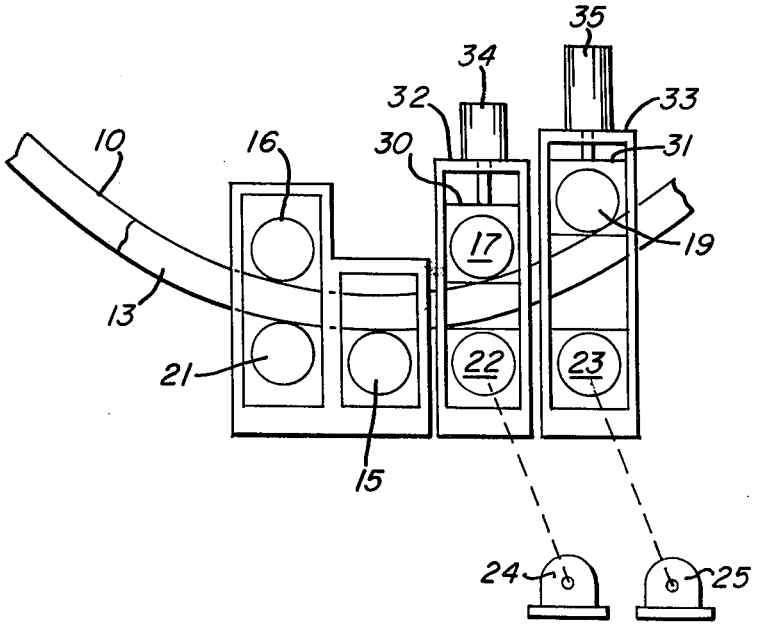
FIG. 3 is a vertical section on III—III of FIG. 1, showing the reaction rolls which follow the fulcrum rolls in their up-positions.
Figure 4:
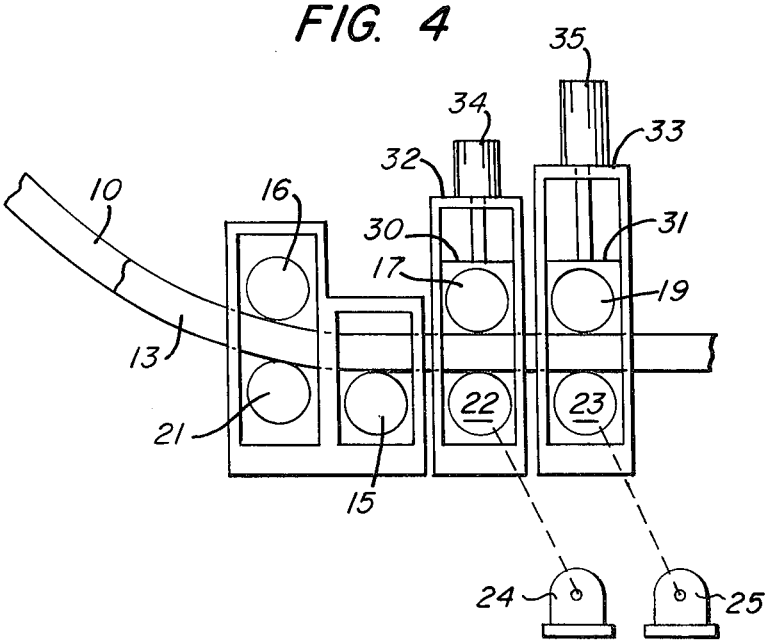
FIG. 4 is a vertical sectional view similar to FIG. 3 but showing the reaction rolls in their down-positions.

FIG. 1 shows a straightener for a four-strand billet or bloom caster. The two outermost strands are indicated at 10 and 12 and two intermediate strands at 13 and 14. The strands travel in parallel closely spaced paths. The straightener includes four coaxial fulcrum rolls 15, four coaxial reaction rolls 16 preceding the fulcrum rolls, and four reaction rolls 17, 18, 19 and 20 following the fulcrum rolls. The fulcrum rolls engage the bottom faces of the respective strands and define a common lower tangent line beyond which the strands are straight. The reaction rolls engage the upper faces of the strands fore and aft of the fulcrum rolls. The straightener also includes bottom rolls 21 which engage the bottom faces of the strands opposite the reaction rolls 16, and bottom rolls 22 and 23 which engage the bottom faces of the outer and intermediate strands 10 and 13 opposite the reaction rolls 17 and 19 (FIGS. 3 and 4). The straightener includes similar bottom rolls (not shown) which engage the bottom faces of strands 12 and 14 opposite the reaction rolls 18 and 20.

Figure 2:
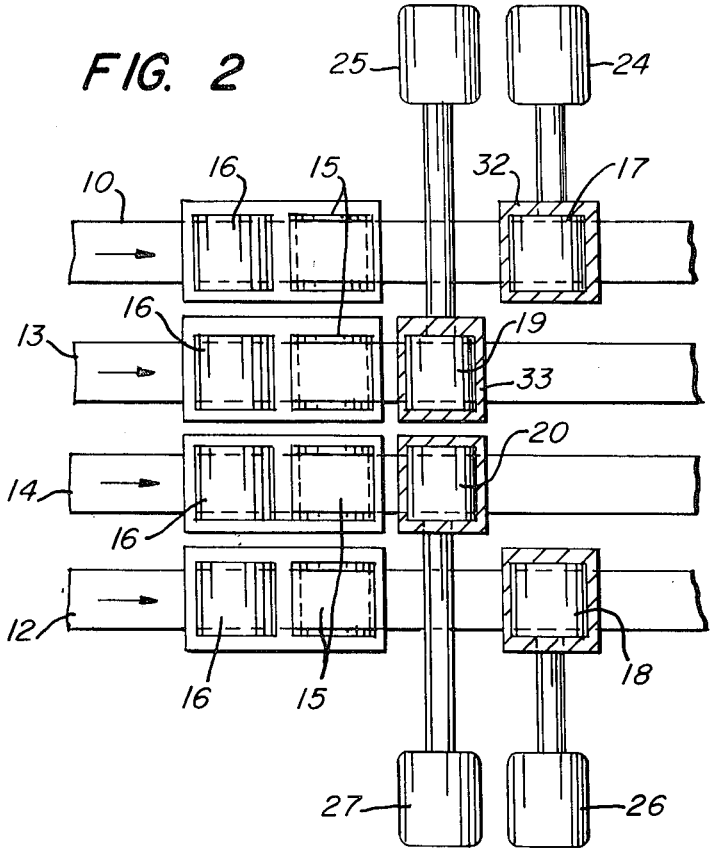
FIG. 2 is a view similar to FIG. 1, but showing a modification.

In accordance with the present invention, the four bottom rolls which engage the strands opposite the reaction rolls 17, 18, 19 and 20 are driven. The other rolls shown, including the fulcrum rolls, are idlers. The intermediate reaction rolls 19 and 20, which engage the intermediate strands 13 and 14, are offset in a direction parallel with the length of the strands from the outer reaction rolls 17 and 18 which engage the outer strands 10 and 12. In the form shown in FIG. 1, the intermediate reaction rolls are farther from the axis of the fulcrum rolls, while in the form shown in FIG. 2 this relation is reversed. Drives 24 and 25 for the outer and intermediate bottom rolls 22 and 23 are located outside the outermost strand 10. Likewise drives 26 and 27 for the outer and intermediate bottom rolls opposite the reaction rolls 18 and 20 are located outside the outermost strand 12. In each instance the drives are aligned with their respective bottom rolls and are directly connected thereto. The drives for the intermediate rolls are offset from the drives for the outer rolls in the same relation as the rolls themselves.

As shown in FIG. 3, the reaction rolls 17 and 19 are journaled in chocks 30 and 31 respectively which are supported in housings 32 and 33 for vertical adjustment. Hydraulic cylinders 34 and 35 are mounted on the respective housings for applying pressure to the strands and effecting adjustment of the position of the reaction rolls. The housing 33 is higher than housing 32, and the cylinder 35 on the housing 33 has a longer stroke than the cylinder 34 on the housing 32. As the leading ends of strands 10 and 13 pass the fulcrum rolls 15, the strands initially retain their curvature and bend upwardly as shown in FIG. 3. The outer strand 10 reaches the reaction roll 17 at a relatively short distance from the fulcrum roll 15, while the intermediate strand 13 reaches the reaction roll 19 at a greater distance from the fulcrum roll. Hence the intermediate strand bends upwardly to a greater extent than the outer strand, and there is need for a wider range of adjustment of the intermediate reaction roll. This arrangement of course is reversed in the modification shown in FIG. 2. When the strands reach approximately the positions shown in FIG. 3, cylinders 34 and 35 are operated to lower the reaction rolls 17 and 19 to the positions shown in FIG. 4. The reaction rolls 18 and 20 are lowered in like manner, thus straightening the four strands.

From the foregoing description, it is seen that the present invention affords a simple practical straightener for a multistrand continuous-casting machine. The drive for each driven roll is connected directly to the roll, and there is no need for complex gearing to transmit driving torques. The reaction rolls and opposite bottom rolls which follow the fulcrum rolls serve also as pinch rolls for propelling the strand. This arrangement overcomes any need to drive the fulcrum rolls which are coaxial and not readily offset from one another. Preferably the housings of the reaction rolls are independent of the housings of the fulcrum rolls. Hence the foundation becomes the connecting stress member. While I have illustrated the invention as applied to a four-strand casting machine, it is apparent that it can be used with a casting machine in which any number of strands greater than two are cast.

I claim:

1. In a multistrand continuous-casting machine in which two outer strands and at least one intermediate strand travel in parallel paths located close to one another, an improved straightener comprising:

coaxial fulcrum rolls for engaging the bottom faces of the respective strands and defining a common lower tangent line for the strands;

outer and intermediate reaction rolls for engaging the upper faces of the respective strands both preceding and following the fulcrum rolls;

the intermediate and outer reaction rolls which follow the fulcrum rolls being spaced at different distances from the axis of the fulcrum rolls;

respective bottom rolls opposite said reaction rolls; and drive means operatively connected with the bottom rolls opposite the outer and intermediate reaction rolls which follow the fulcrum roll and being located outside the paths of the outer strands;

said drive means being aligned with the respective rolls which they drive.

2. A straightener as defined in claim 1 in which there are at least two intermediate strands and two intermediate reaction rolls which follow the fulcrum rolls, the drive means for the bottom rolls opposite the intermediate reaction rolls being located outside opposite outer rolls.

3. A straightener as defined in claim 1 in which the intermediate reaction roll which follows the fulcrum rolls is farther from the axis of the fulcrum rolls than the outer reaction rolls.

4. A straightener as defined in claim 1 in which the outer reaction rolls which follow the fulcrum rolls are farther from the axis of the fulcrum rolls than the intermediate reaction rolls.

5. A straightener as defined in claim 1 in which said reaction rolls following the fulcrum rolls and the opposite driven rolls serve as pinch rolls to propel the strands.

6. A straightener as defined in claim 1 in which the fulcrum rolls and the reaction rolls which precede the fulcrum rolls are idlers.

7. A straightener as defined in claim 1 comprising in addition vertically adjustable means in which the reaction rolls which follow said fulcrum rolls are journaled, said adjustable means providing a range of adjustment for each reaction roll at least to the extent to which a strand engaged by the roll bends upwardly initially as the leading end of the strand passes the fulcrum roll.

8. A straightener as defined in claim 7 in which the reaction roll farther from the fulcrum roll has a wider range of adjustment than the reaction roll closer to the fulcrum roll.

* * * * *